US008607395B2

(12) United States Patent
Karasek

(10) Patent No.: US 8,607,395 B2
(45) Date of Patent: Dec. 17, 2013

(54) CARBOY CLEANER

(76) Inventor: Ryan F. Karasek, Champlin, MN (US)

( * ) Notice: Subject to any disclaimer, the term of this patent is extended or adjusted under 35 U.S.C. 154(b) by 549 days.

(21) Appl. No.: 12/820,380

(22) Filed: Jun. 22, 2010

(65) Prior Publication Data

US 2011/0146710 A1 Jun. 23, 2011

Related U.S. Application Data

(60) Provisional application No. 61/269,222, filed on Jun. 22, 2009.

(51) Int. Cl.
*B08B 9/045* (2006.01)

(52) U.S. Cl.
USPC ..... 15/104.14; 15/104.09; 15/104.18; 15/72; 15/213

(58) Field of Classification Search
USPC ..... 15/65, 104.09, 104.096, 104.65, 15/104.17, 165
See application file for complete search history.

(56) References Cited

U.S. PATENT DOCUMENTS

| | | | | |
|---|---|---|---|---|
| 117,741 | A * | 8/1871 | Clark | 15/97.1 |
| 392,102 | A | 10/1888 | Butz | |
| 502,414 | A | 8/1893 | Flower | |
| 564,497 | A | 7/1896 | Babis | |
| 602,071 | A | 4/1898 | Goulding | |
| 684,665 | A | 10/1901 | Babis | |
| 700,499 | A | 5/1902 | Irving | |
| 856,191 | A * | 6/1907 | Roch, P. | 15/213 |
| 906,836 | A | 12/1908 | Volckening | |
| 912,085 | A | 2/1909 | Davis | |
| 961,563 | A * | 6/1910 | Volckening | 15/104.9 |
| 1,082,502 | A | 12/1913 | Clifford | |
| 1,205,290 | A * | 11/1916 | Turner | 15/104.9 |
| 1,306,478 | A | 6/1919 | Grass | |
| 1,317,303 | A | 9/1919 | McDonnell | |
| 1,507,971 | A * | 9/1924 | Lomp | 15/26 |
| 1,657,527 | A | 6/1928 | DeMartelaere | |
| 1,851,079 | A | 3/1932 | Bartlett | |
| 1,857,584 | A | 5/1932 | Bolagek | |
| 2,128,822 | A | 8/1938 | Home | |
| 2,334,690 | A | 11/1943 | Yden | |
| 2,828,502 | A | 4/1958 | Tupper | |
| 3,116,576 | A | 1/1964 | Block | |
| 3,409,926 | A | 11/1968 | Martin | |
| 4,287,633 | A * | 9/1981 | Gropper | 15/229.11 |
| 7,543,348 | B2 | 6/2009 | Le | |
| 2004/0177864 | A1 * | 9/2004 | Segalla | 134/8 |

* cited by examiner

*Primary Examiner* — Saeed T Chaudhry
(74) *Attorney, Agent, or Firm* — Beck & Tysver PLLC

(57) ABSTRACT

A device for cleaning carboys, kegs, and similar containers is disclosed. The device includes a pair of cleaning pads pivotally attached to a rod. Each pad has a fabric exterior, a stiffening insert, and the absorbent sponge. The insert and sponge are placed on one side of the fabric exterior. The opposite side of the fabric exterior is folded over the stiffening insert and the sponge and then sewn together.

1 Claim, 5 Drawing Sheets

40
40

20
10
20
54
50
30
52
60
50
30
30
52

CARBOY CLEANER

CROSS-REFERENCES TO RELATED APPLICATIONS

This application claims the benefit of U.S. Provisional Application No. 61/269,222, filed Jun. 22, 2009, and hereby incorporated by reference.

FIELD OF THE INVENTION

The present invention relates to an apparatus and method for cleaning the inside of containers. More specifically, it relates to an apparatus and method for cleaning carboys, kegs, and similar containers.

SUMMARY OF THE INVENTION

A cleaning device is disclosed that includes a pair of cleaning pads pivotally attached to the distal end (i.e., "distal" relative to a user of the device) of a rod. Each pad has a fabric exterior, a plastic insert, and the absorbent sponge. The insert and sponge are placed on one side of the fabric exterior. The opposite side of the fabric exterior is folded over the plastic insert and the sponge and then sewn together. The sponge is located at the end of the cleaning pad opposite from where the pad attaches to the rod.

To use the device, cleaning solution is poured into the bottom of the container. The proximal (relative to a user of the cleaning device) end of the rod is attached to an electric drill. The distal end of the device is lowered into the container, allowing the sponge and fabric to soak up solution. The drill is turned on. The weight and positioning of the wet sponges cause the two pads to assume an approximately horizontal position, engaging the inner walls of the container. The device is moved up and down to clean the sides. The flexibility of the inserts and sponges will allow the cleaning pads to conform to curvature in the bottom and near the mouth of the container.

DETAILED DESCRIPTION OF EXEMPLARY EMBODIMENTS

The figures, and associated descriptions below, depict some representative embodiments of the invention. They should not be interpreted to limit the scope of the invention.

Figures 1, 2:
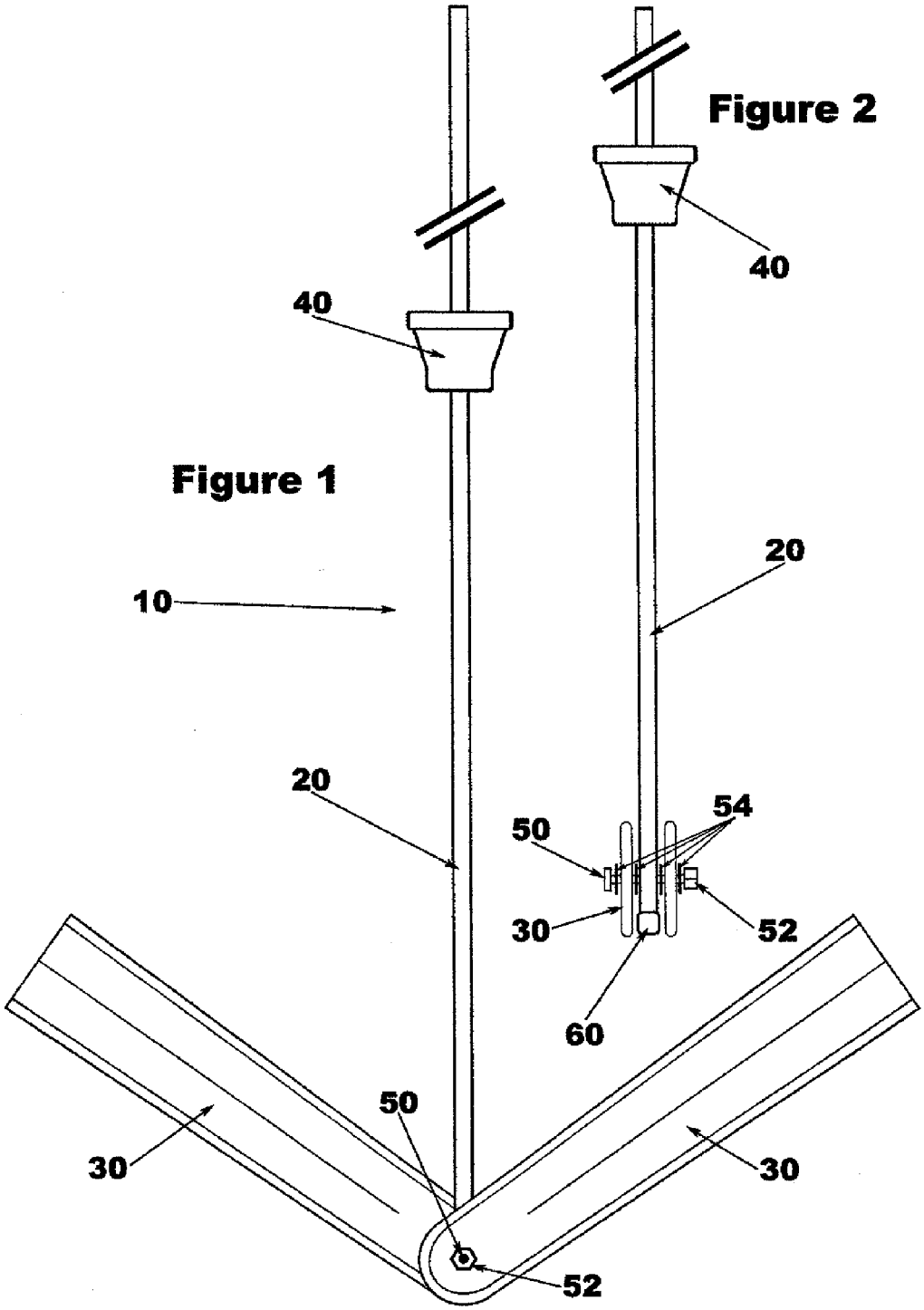
FIG. 1 is a front elevation view of one embodiment of the present invention.
FIG. 2 is a side elevation view of the embodiment of the present invention shown in FIG. 1.

FIG. 1 shows a first embodiment of the carboy cleaning device 10. The device 10 is designed to clean carboys, kegs, demijohns, and similar containers, such as those used to create, store, or transport alcoholic beverages, such as wine or beer. In principal, the device can be used with any vessel made out of plastic, glass, metal, ceramic, or similarly rigid material that has an interior surface that is generally symmetrical about an axis of rotation. In the present disclosure, such as vessel will be called a carboy, although such language should not be viewed as limiting the applicability of the invention.

The device 10 includes a stainless steel rod 20 pivotally attached, at the distal end 21 of the rod 20, to a pair of cleaning pads 30. A stainless steel bolt 50, attached with a matching locking nut 52 holds the cleaning pads 30 to the rod 20, as is more clearly seen in FIG. 2. Nylon washers 54 are used to allow the cleaning pads 30 to pivot easily about the bolt 50. The bolt 50 passes through a hole (not shown) at the distal end 21 of rod 20.

The cleaning rod 20 is preferably made of stainless steel of approximately 1 cm in diameter. In one embodiment, the diameter is 0.9525 cm. Other materials could be used such as aluminum, non-stainless steel, composite or any other material that can withstand the rotational speed of a drill without any significant deformation or wobbling. The diameter of the rod 20 is chosen to be thick enough for stability in rotation without being unreasonably heavy during use. The diameter is also preferably small enough to be easily fitted into a standard cordless drill, although this is not necessary. The length of the cleaning rod 20 is scaled by the size and height of the container or carboy to be cleaned. For example, a 61 cm cleaning rod 20 could be used for a twenty-three liter carboy, while a 34 cm cleaning rod 20 may be more appropriate for a 3.78 liter (1 gallon) carboy.

The bolt 50 is a #8-32 stainless steel bolt approximately 2.5 cm long. The bolt 50 and locking nut 52 are standard and can be purchased commercially. Shorter sizes can be used for smaller size containers with smaller container openings. A #8-32 stainless steel locking nut is used. Other types of materials and methods may be used to hold in the cleaning pads 30 in place as long as such methods allow for free movement of the cleaning pads 30.

Four standard nylon washers 54 are used as spacers. The overall diameter of each washer 54 is approximately 1 cm. The diameter center hole in the washer 54 is approximately 0.5 cm. The thickness of the washer 54 is approximately 1-2 mm. Other washer materials like silicone, vinyl, and even metal can be used to provide separation for unrestricted movement of the cleaning pads 30.

The diameter of the rubber cap 60 is approximately 1-2 mm smaller than the diameter of the cleaning rod 20. The height of the rubber cap 60 is approximately 1 cm. Other materials or styles of caps 60 could be used to prevent the direct contact of the cleaning rod 20 and the bottom of the carboy.

The cleaning pads 30 are generally attached to the rod 20 in pairs, such as is shown in FIGS. 1 and 2, although it would be feasible to construct a device 10 that contains more than one pair of pads 30, as long as the pads 30 are added to the device 10 in pairs so as to balance each other out during rotation.

Figure 3:
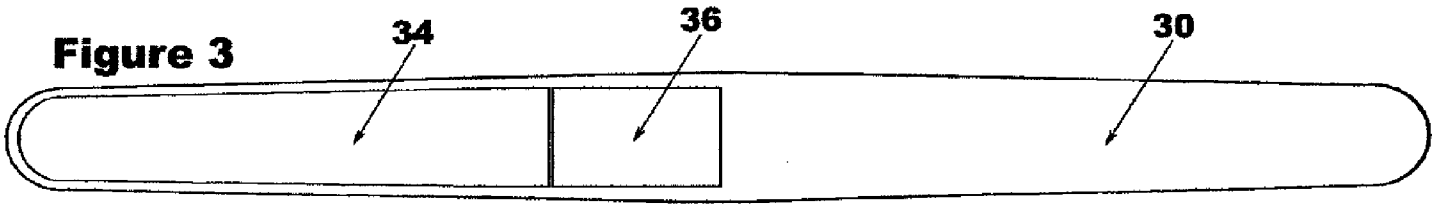
FIG. 3 is a front elevation view of an unsealed pad used in the embodiment of the present invention shown in FIG. 1.
Figure 4:
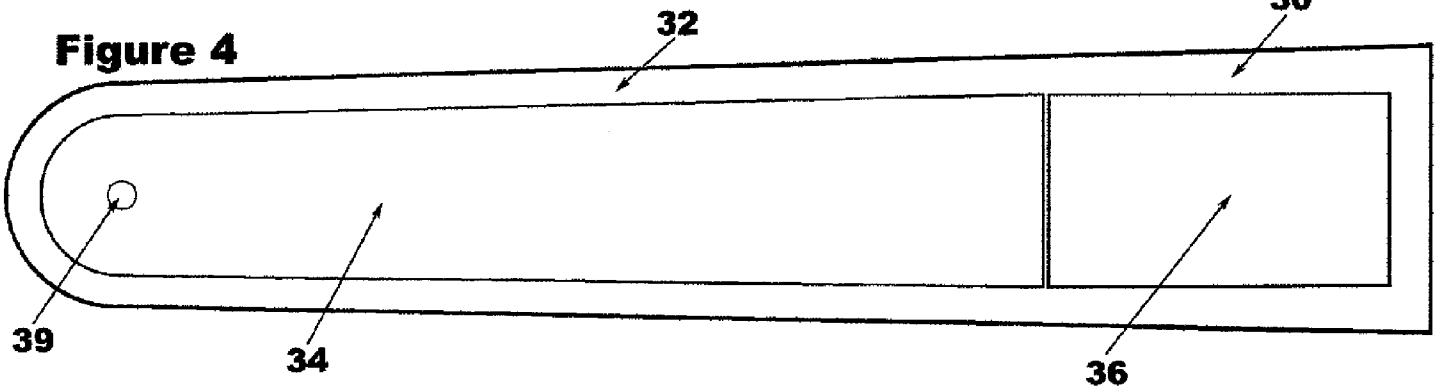
FIG. 4 is a front elevation view of the left side of the unsealed pad shown in FIG. 2.
Figure 5:
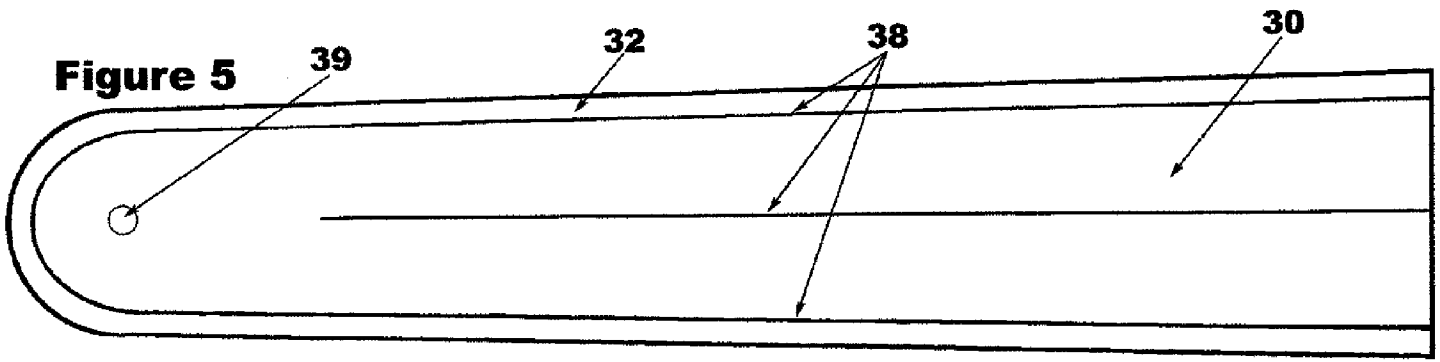
FIG. 5 is a front elevation view of the pad shown in FIG. 4 after it is sealed.

The construction of the cleaning pads 30 is shown in FIG. 3 through 5. Each cleaning pad 30 is assembled utilizing three main components, namely a fabric exterior 32, a stiffening insert 34 or member, and the absorbent sponge 36. The insert 34 will typically be made, in whole or substantial part, of plastic. The fabric exterior 32 is assembled by placing the stiffening insert 34 and absorbent sponge 36 on one side of the laid out, pre-cut fabric exterior 32, as is shown most clearly in FIG. 4. The stiffening insert 34 and the absorbent sponge 36 can be glued to the fabric 32 to assist in consistent assembly during the sewing process. The opposite side of the fabric exterior 32 is then folded over the stiffening insert 34 and the sponge 36, and then the two sides of the fabric exterior 32 are sewn together. The thread pattern 38 that holds the cleaning pad 30 together has stitching along the periphery of the cleaning pad 30 and a stitch down the center. The thread, method, and style of the stitching 38 can vary depending on the type of fabric exterior 32 being used. A hole 39 is then punched through the fabric and stiffening insert 34 near the end of the cleaning pad 30 opposite of the absorbent sponge 36. The hole 39 should be large enough for the bolt 50 to fit through. A grommet can be used to secure the hole 39. The size and the style of the cleaning pad 30 can vary depending on the appropriate size of the carboy 100 that is to be cleaned.

The fabric exterior 32 is made of a non-woven viscose fabric. Other types of fabrics can be used, including but not limited to: PVA chamois, Microfiber, Ultra Microfiber Nest/Jersey Fabric, and Terry Cloth. Any fabric that can withstand high stress, stretching, repetitious submergence in water and cleaning solutions can be used. The size and shape will vary relative to the appropriate size of the carboy to be cleaned.

The stiffening insert 34 may be a semi-rigid plastic cut to an appropriate shape. The plastic may be polyethylene, PVC, or other thermoplastic, although any material can be used that is rigid enough to hold its shape under strong rotational forces while still be flexible enough to allow some twisting during the cleaning of the top of the carboy. In one embodiment, the material for the insert 34 is chosen to allow sewing needles to penetrate to create the thread pattern 38 that holds the fabric exterior 32 in place, although this is not necessary if a different pattern 38 or other technique for holding the pad 30 together is used. The insert 34 is approximately 1.0-1.5 mm thick. The size and shape will vary relative to the appropriate size of the carboy to be cleaned.

The absorbent sponge 36 is cellulose sponge material. Preferably the sponge 36 will consist of compressed cellulose sponge material, of a type available from 3M. For a given carboy cleaner, the dry thickness of the sponge 36 will preferably be approximately equal to the of the stiffening insert 34, namely, about 1.0-1.5 mm. Other absorbent sponge material can be used, so long as it can quickly absorb enough water and cleaning solution to add sufficient weight to the end of the cleaning pad 30. This weight aids in creating sufficient centrifugal force during rotation for the cleaning pads 30 to rotate out and clean the interior walls of the carboy. The length and width of the sponge 36 sponge will vary relative to the size of the carboy to be cleaned.

Figure 9:
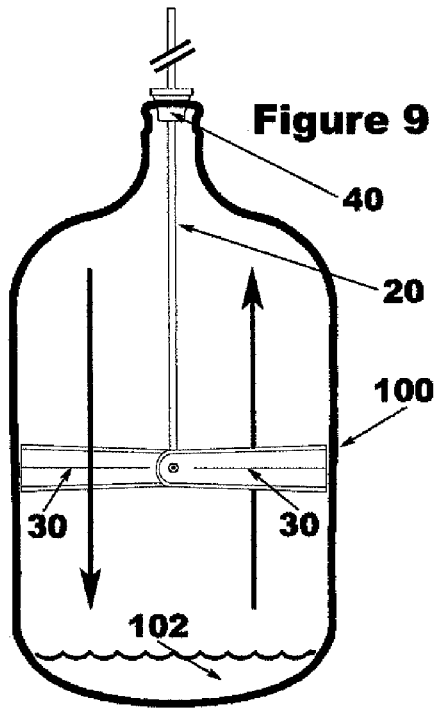
FIG. 9 shows the fourth step in the process of using the embodiment shown in FIG. 1.

When the device 10 is cleaning the interior side walls of the container 100, the wet sponge and rotation will cause the cleaning pads 30 to extend into an approximately horizontal position, as illustrated by FIG. 9. Thus, the combined length of the extended pair of pads 30 will be preferably be approximately equal to the diameter of the container 100.

In some embodiments, the rod 20 passes through the center hole of a rubber bung 54. Such rubber bungs 54 are commercially produced by Buon Vino Manufacturing Incorporated and can be purchased in varying sizes depending on the size of the carboy being cleaned. The hole through the center of the bung through which the rod 20 is passed is preferably 2-3 mm larger than the diameter of the cleaning rod 20 being used. Alternatively, a stopper, plug, or cork might be used to prevent liquid from splashing out from the carboy 100 during cleaning with the device 10.

Figure 6:
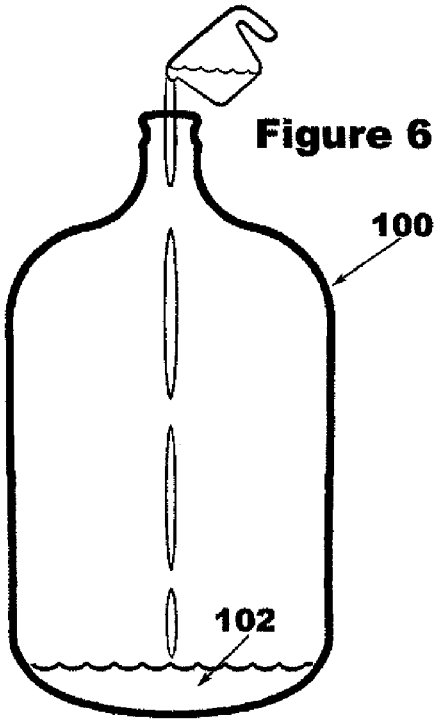
FIG. 6 shows the first step in the process of using the embodiment shown in FIG. 1.

An embodiment of the process for cleaning a carboy 100 with the device 10 is shown in FIG. 6 through 12. The first step is to pour in a cleaning solution 102, as shown in FIG. 6. The solution ideally should cover the bottom of the carboy 100, but it need not have a great depth. For example, with twenty-three liter carboy 100, the solution may include three to four cups of water along with a smaller amount of a concentrated cleaning liquid.

Figure 7:
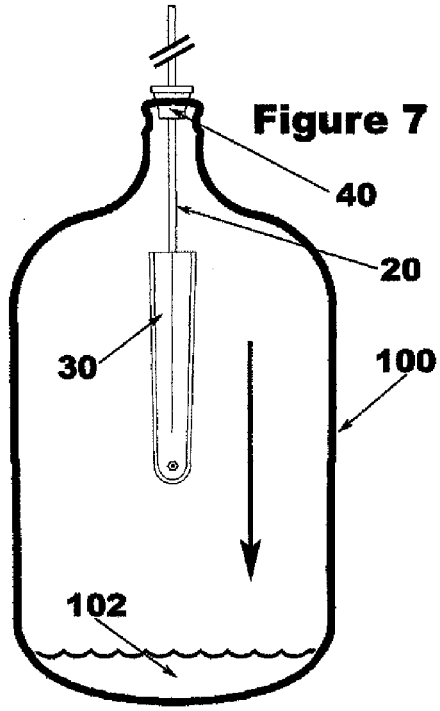
FIG. 7 shows the second step in the process of using the embodiment shown in FIG. 1.

Next, the cleaning rod 20 should be prepared by running the rod 20 through the center hole of the rubber bung 54. The proximal end 22 of the rod 20 opposite the pads 30 is then attached to a drill or other rotational driver. Ideally, the drill should be cordless to prevent the risk of electrical shock while using the device 10. At this point, the end of the cleaning rod 20 and the attached pads 30 are inserted into the carboy 100. The rubber bung 54 should be pushed into the mouth of the carboy, where it should fit snuggly. The cleaning rod 20 should move freely up and down inside the carboy 100, with the rod 20 being centered within the mouth of the carboy 100 by the bung 54. This is shown in FIG. 7.

Figure 8:
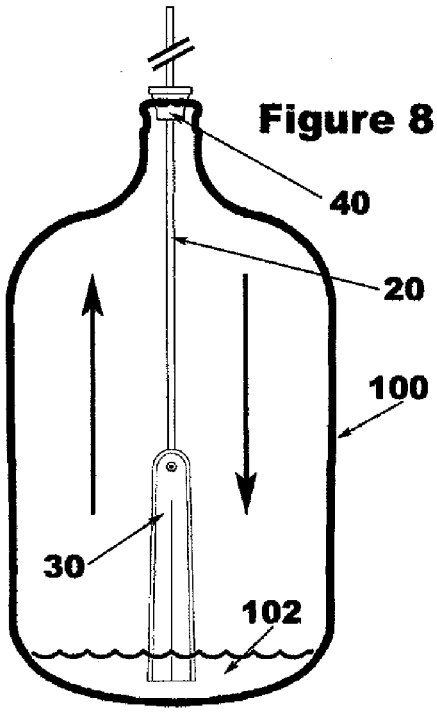
FIG. 8 shows the third step in the process of using the embodiment shown in FIG. 1.

At this point, the cleaning rod 20 should be lifted up and down until the cleaning pads 30 settle with sponge 36 end of the pads 30 (opposite the attachment to the rod 20) pointed downward. At this point, the pads 30 and sponges 36 should be allowed to absorb the cleaning solution 102, as shown in FIG. 8.

Next, the cleaning rod is spun by the drill (such as in a clockwise direction). As the rod 20 spins, the centrifugal force draws the cleaning pads 30 up and out to the inner walls of the carboy. In most cases, the pads 30 will naturally extend outward opposite one another. If they do not, and instead extend in the same direction, rotation should be stopped until the pads 30 are again in the position shown in FIG. 8. Rotation can then be restarted as needed until the pads 30 are opposite one another, as shown in FIG. 9. This technique can be used to reset the pads 30 if they ever get out of position during the cleaning process.

In one embodiment, the spinning of the rod 20 starts slowly until the pads 30 have engaged the walls of the carboy 100. Note that the length of the pads 30 is chosen to ensure that the pads 30 sufficiently engage the carboy 100 walls during rotation. While the rod 20 is spinning and the pads 30 are rubbing against the carboy 100 walls, the rod 20 is moved up and down by a user to ensure that all of the carboy 100 walls are cleaned. This movement is shown by the arrows in FIG. 9. Occasionally, the pads 30 should be lowered into the cleaning solution 102 to absorb more solution.

Figure 10:
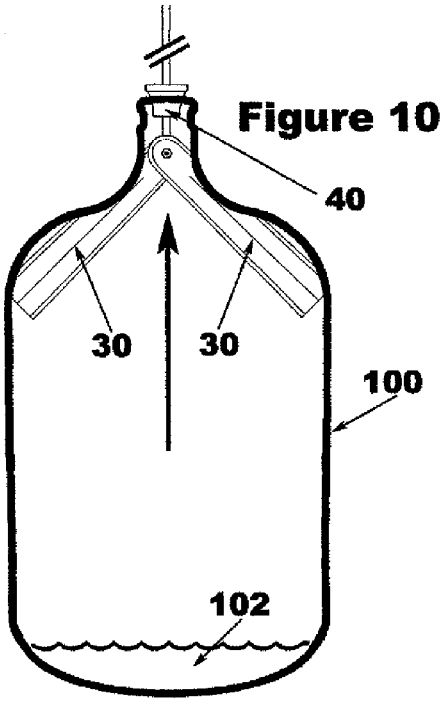
FIG. 10 shows the fifth step in the process of using the embodiment shown in FIG. 1.

To clean the top of the carboy's interior, rotation of the pads 30 is maintained and the rod 20 is withdrawn until the pads 30 reach the top interior surface of the carboy, as shown in FIG. 10. The cleaning pads 30 are design to twist and flex so as to maintain contact with the irregular curves and neck found at the top of the carboy 100. Withdrawing the pads 30 slowly out of the neck during rotation will clean the neck of the carboy, although it may be necessary to remove the bung 54.

Figure 11:
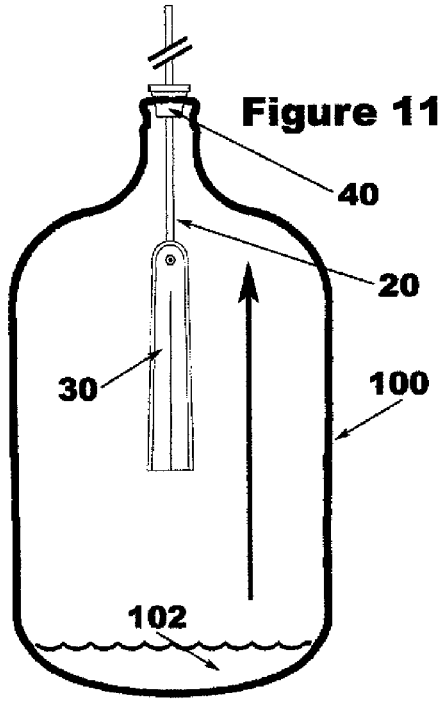
FIG. 11 shows the sixth step in the process of using the embodiment shown in FIG. 1.
Figure 12:
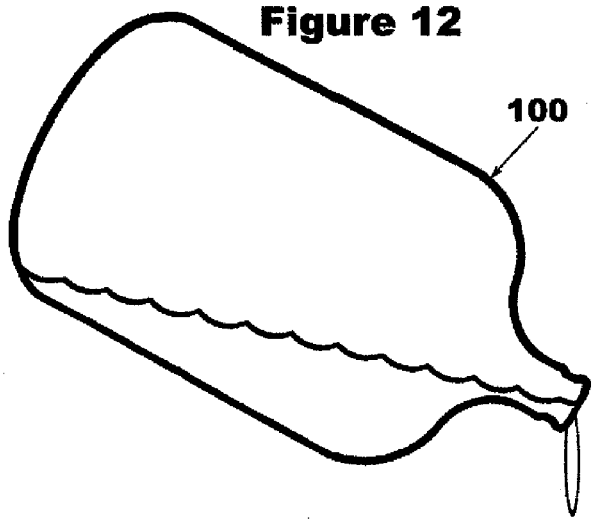
FIG. 12 shows the seventh step in the process of using the embodiment shown in FIG. 1.

When cleaning is complete, the rotation of the rod 20 and the cleaning pads 30 is stopped, as shown in FIG. 11. The device 10 can then be removed from the carboy 100. The device 10 should then be rinsed and dried for storage and later reuse. As shown in FIG. 12, it is advisable to thoroughly rinse the carboy with water to remove the cleaning solution 102. The carboy 100 can also be sanitized after cleaning, such as with a potassium metabisulfite solution.

Figure 13:
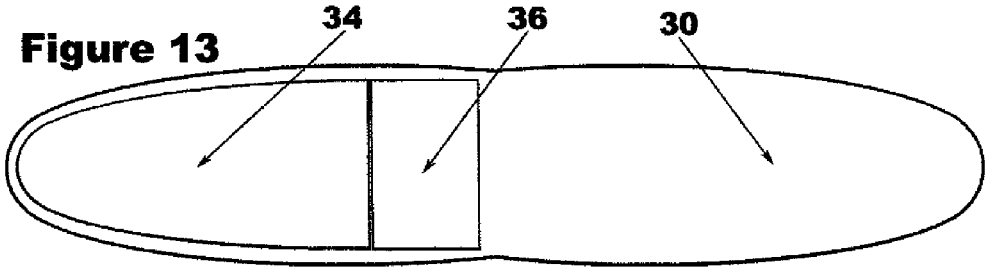
FIG. 13 is a front elevation view of an unsealed pad used in another embodiment of the present invention.
Figure 14:
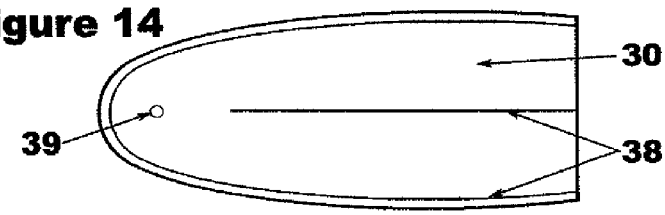
FIG. 14 is a front elevation view of the pad shown in FIG. 13 after it is sealed.

FIG. 13-17 illustrate the use of another embodiment of the invention. A corny keg 200, also known as a cornelius keg or corney keg, is a generally cylindrical metal container used to store and dispense liquids, typically beer or soft drinks. FIG. 13 shows an unsealed cleaning pad 30 designed for washing a corny keg 200. FIG. 14 shows the pad 30 after it has been sealed and a hole 39 has been punched through it. The arrangement of the sponge 36, thread pattern 38, and hole 39 within the pad 30 are similar to those described in connection with FIGS. 4 and 5. The particular example of an pad has a length of 31.5 and a width of 6.5 at its widest point. This width of the pads 30, close to their point of attachment to the rod, was chosen to be sufficiently large so as to prevent contact between the distal end 21 of the rod 20 and the inside bottom surface of the carboy 100. Consequently, the end cap 60 on the rod 20 could be eliminated from this embodiment.

Figure 15:
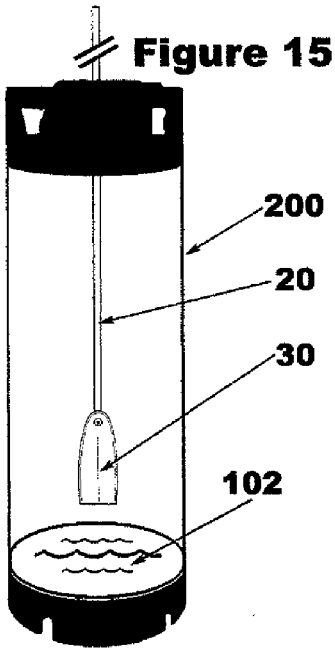
FIG. 15 is a front elevation view of the embodiment of the present invention from FIG. 13, after it has been lowered into a corny keg.
Figure 16:
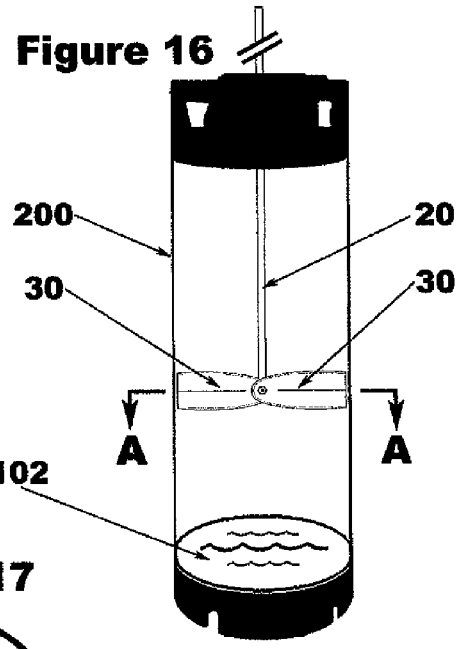
FIG. 16 is a front elevation view of the embodiment of the present invention from FIG. 13, in operation within a corny keg.

A corny keg 200 may have an elliptical hole at the top. Consequently, the cleaning device 10 may be used without a bung 54 comparable to that shown in FIG. 1, with the rod 20 being inserted directly into the keg 200 through the elliptical hole. FIG. 15 shows the device 10 after insertion into a keg 200, with two pads 30 hanging vertically from a bolt 50 passing through the rod 20, prior to being soaked in cleaning solution 102. FIG. 16 shows the cleaning pads 30 after they have achieved an approximately horizontal position after rotation of the rod 20 has begun. The metal keg 200 has been made to appear translucent in FIGS. 15 and 16 so as not to hide the device 10 from view. As in FIG. 9, arrows show the direction that the device 10 should be moved while the pads 30 are rotating in order to clean the inside walls of the container.

Figure 17:
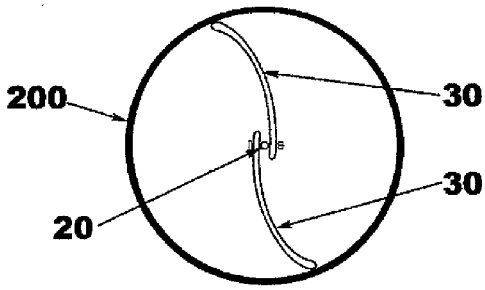
FIG. 17 is a cross section perpendicular to the axis of the rod, showing typical deformity of the embodiment of the present invention from FIG. 13, as it rotates within a corny keg.

FIG. 17 depicts cross-section A-A' through the pads 30 of the cleaning device 10 and keg 200 shown in FIG. 16. The cross-section is perpendicular to both the rod 20 and the sides of the keg 200. This figure gives an example of how the rotation can combine with the heavy wet sponges 36 to deform the stiff yet flexible inserts 34 to apply the requisite friction to thoroughly scrub the walls of the keg 200.

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims and equivalent constructions.

What is claimed is:

1. An apparatus, comprising:

a) a shaft with a distal end; and b) two pads attached at the distal end of the shaft so as to allow the pads to pivot freely about an axis that is perpendicular to the shaft, each pad including a sponge, wherein each pad has ends proximal to and distal from the axis, and the sponge is positioned toward the distal end of the pad, and each pad pivots toward an orientation perpendicular to the shaft, due to rotation of the shaft and weight of the sponge after the sponge has been wetted.

* * * * *